US006471797B1

(12) United States Patent
Kim et al.

(10) Patent No.: US 6,471,797 B1
(45) Date of Patent: Oct. 29, 2002

(54) QUASICRYSTALLINE PHASE-REINFORCED MG-BASED METALLIC ALLOY WITH HIGH WARM AND HOT FORMABILITY AND METHOD OF MAKING THE SAME

(75) Inventors: Do Hyang Kim; Won Tae Kim; Dong Hyun Bae, all of Seoul; Eun Soo Park, Kyoungki-do; Seong Hoon Yi, Seoul, all of (KR)

(73) Assignee: Yonsei University, Seoul ( * ) Notice: Subject to any disclaimer, the term of this patent is extended or adjusted under 35 U.S.C. 154(b) by 0 days.

(21) Appl. No.: 09/851,170

(22) Filed: May 9, 2001

(30) Foreign Application Priority Data

Apr. 11, 2001 (KR) ..... 2001-19353

(51) Int. Cl.[7] ..... C22F 1/10; C22F 1/06

(52) U.S. Cl. ..... 148/557; 148/667
(58) Field of Search ..... 148/557, 667

(56) References Cited

U.S. PATENT DOCUMENTS 5,139,077 A * 8/1992 Das et al. ..... 164/66.1
5,851,317 A 12/1998 Biner et al.

* cited by examiner

*Primary Examiner*—Sikyin Ip
(74) *Attorney, Agent, or Firm*—Rosenberg, Klein & Lee

(57) ABSTRACT

Disclosed is a quasicrystalline phase-reinforced Mg-based metallic alloy with high warm and hot formability, and making method thereof. The metallic alloy comprises a composition of Mg—1~10 at % Zn—0.1~3 at % Y, in which a two-phase region consisting of a quascrystalline phase and a magnesium-based solid solution phase exists. Constituting a matrix structure, the Mg-based solid solution phase (α—Mg) is formed as a primary solid phase upon solidification. The quasicrystalline phase serves as a second phase and forms, together with the Mg-based solid solution phase, a eutectic phase, thereby reinforcing the matrix. The materials obtained through the hot rolling or extrusion of the cast alloy have an increased volume % of the second phase and thus show significantly increased strength.

3 Claims, 4 Drawing Sheets

QUASICRYSTALLINE PHASE-REINFORCED MG-BASED METALLIC ALLOY WITH HIGH WARM AND HOT FORMABILITY AND METHOD OF MAKING THE SAME

BACKGROUND OF THE INVENTION

1. Field of the Invention

The present invention relates, in general, to a quasicrystalline phase-reinforced Mg-based metallic alloy superior in warm and hot formability and, more particularly, to an Mg—Zn—Y alloy which has a two-phase region consisting of a quasicrystalline phase and a magnesium-based solid solution phase, in which the solid solution is formed as a primary phase constituting a matrix structure upon solidification, while the quasicrystalline phase serves as a second phase and forms, together with the solid solution phase, a eutectic phase, thereby reinforcing the matrix.

2. Description of the Prior Art

Casings for portable electronic appliances, such as mobile phones, or materials for automobile parts are required to be of light weight, high strength, high toughness, and high formability.

While crystals generally have one-, two-, three-, and six-fold rotational axes of symmetry only, quasicrystals have five-, eight-, ten- and twelve-fold rotational axes of symmetry, which are not formed in crystals. Since their first finding in Al—Mn alloy, quasicrystals have been disclosed to exist in many alloys. For instance, Al—Cu—Fe, Mg—Zn—Y, and Al—Pd—Mn alloys have been reported to have thermodynamically stable quasicrystalline structures. Superior as they are in hardness as compared to crystals of similar compositions, quasicrystals are unsuitable for use as sole structural materials owing to their high brittleness. Recently, reinforced composite materials which comprise metal matrices having reinforcement particles dispersed in the matrix have been developed through powder metallurgy route.

U.S. Pat. No. 5,851,317 discloses composite materials reinforced with quasicrystalline particles and a gas atomization process of making the same, in which aluminum or aluminum alloy particles and spherical Al—Cu—Fe quasicrystalline particles are mixed at an appropriate ratio and hot pressed or hot extruded to form a composite product of high strength with interfacial bonding between the quasicrystalline particles and the aluminum or aluminum alloy particles.

The composite materials of the cited reference have the advantage of being made to show versatile mechanical properties by controlling the amounts of components, but the disadvantage of being poor in bonding strength between component particles. In case particles that are likely to be coated with oxides, such as aluminum or aluminum alloy particles, are used as starting materials, the oxide coatings deteriorate the bonding between the matrix metal particles and the reinforcement particles, giving rise to a decrease in mechanical properties, especially elongation and fracture toughness. Additionally, the composite materials are not advantageous in terms of product reliability and production cost owing to their complicated production procedure and many production parameters.

Further, Al—Cu—Fe alloy is unsuitable as materials for use in casings for electronic appliances or materials for automobile parts, which require lightness, high strength, high toughness and high formability because the quasicrystalline phase region in Al—Cu—Fe alloy is surrounded by various brittle intermetallic phase regions.

Therefore, there remains a need for the alloy that has a quasicrystalline phase as a second phase dispersed in the metal solution so that it is provided with all of the above mechanical properties in addition to being of high formability.

SUMMARY OF THE INVENTION

Leading to the present invention, the intensive and thorough research on metallic alloy, conducted by the present inventors, resulted in the finding that, when Mg—Zn—Y alloy is solidified from a liquid state, the quasicrystalline phase particles in the matrix of the metal solid solution acts as a reinforcement, which brings about an improvement in the mechanical properties of quasicrystalline phase-reinforced materials and their production cost. In the present invention, the Mg—Zn—Y alloy is defined as the composition range which allows hot molding processes to be applied to the alloy.

Therefore, it is an object of the present invention to overcome the above problems encountered in prior arts and to provide a quasicrystalline phase-reinforced magnesium-based metallic alloy with excellent warm and hot formability, in which a two-phase region consisting of a quasicrystalline phase and a magnesium-based solid solution phase exists, said magnesium-based solid solution phase (alpha magnesium) being formed as a primary solid phase, constituting a matrix structure upon being solidified, said quasicrystalline phase serving as a second phase and forming, together with the magnesium-based solid solution phase, a eutectic phase, thereby reinforcing the matrix.

It is another object of the present invention to provide a method of making such an quasicrystalline phase-reinforced magnesium-based metallic alloy by subjecting a magnesium-based metallic alloy composition to hot forming to separate and disperse a quasicrystalline phase of micro particles throughout the metallic matrix, so as to bring about an improvement in room temperature mechanical properties as well as high-temperature elongation.

DETAILED DESCRIPTION OF THE PRESENT INVENTION

In an aspect of the present invention, there is provided a quasicrystalline phase-reinforced Mg-based metallic alloy superior in warm and hot formability, which has a two-phase region consisting of a quasicrystalline phase and an Mg-based solid solution phase. When being solidified, the Mg-based solid solution phase (alpha magnesium) is formed as a primary solid phase, constituting a matrix structure. Meanwhile, the quasicrystalline phase serves as a second phase and forms, together with the magnesium-based solid solution phase, a eutectic phase, thereby reinforcing the matrix structure.

In an embodiment, the quasicrystalline phase-reinforced Mg-based metallic alloy has a composition of 1–10 at % Zn, and 0.1–3 at % Y, the remainder Mg.

In another aspect of the present invention, there is provided a method of making a quasicrystalline phase-reinforced magnesium-based metallic alloy, which comprises the steps of: casting a quasicrystalline phase-reinforced magnesium-based metallic alloy consisting of Mg—1~10 at % Zn—0.1~3 at % Y, into a mass, in which a two-phase region consisting of a quasicrystalline phase and a metal solid solution phase exists; and warm or hot forming the mass to separate and disperse the quasicrystalline phase throughout the matrix, so as to provide the quasicrystalline phase-reinforced magnesium-based metallic alloy with improved strength and elongation.

Figure 1:
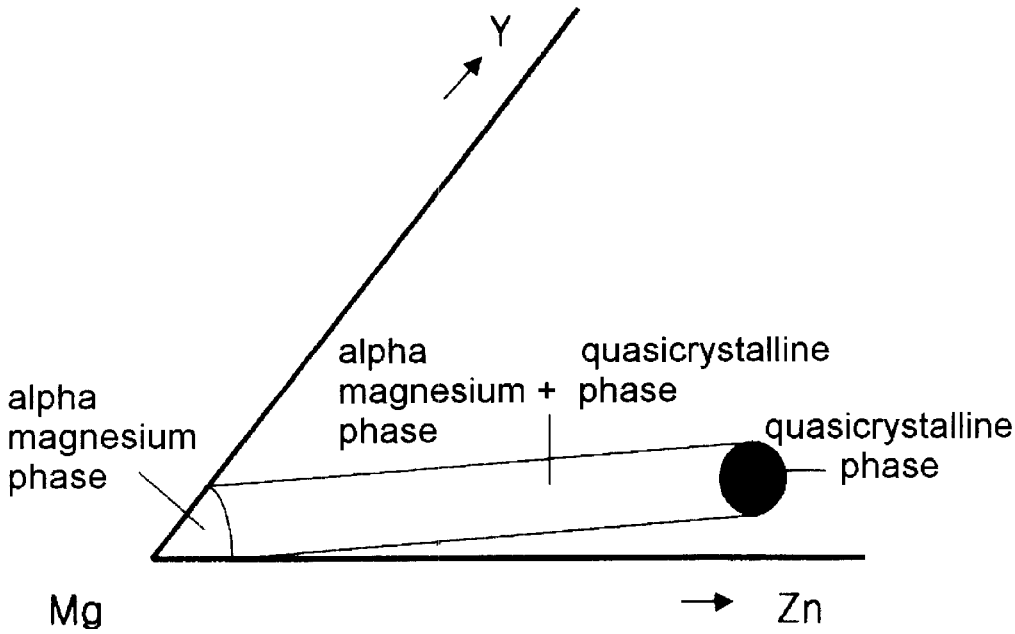
FIG. 1 is a phase diagram of Mg—Zn—Y alloy showing a two-phase region of an alpha magnesium phase and a quasicrystalline phase.

When being solidified from a liquid state, the quasicrystalline phase-reinforced Mg-based metallic alloy is required to have a two-phase region consisting of a quasicrystalline phase and a metal solid solution phase. To this end, Mg—Zn—Y alloys are suitable because thermodynamically stable quasicrystalline phase exists therein. During solidification of Mg—Zn—Y alloys, a eutectic reaction occurs in which a magnesium-based solid solution phase and a quasicrystalline phase are formed during solidification from a liquid state. Mg—Zn—Y alloys have a two-phase region of the magnesium-based solid solution phase and a quasicrystalline phase as seen in the phase diagram of FIG. 1.

The quasicrystalline phase-reinforced Mg-based metallic alloys of the present invention may be prepared into ingot or slab from a molten metal of Mg—Zn—Y alloys by a conventional casting method such as gravity die casting.

In addition, when the alloys are fabricated into plates by hot rolling or extrusion at a temperature ranging from half the melting point to the melting point at which common wrought materials are produced, the interface between the matrix and the quasicrystalline phase is not destroyed, but the quasicrystalline phase is separated and dispersed throughout the matrix. This hot forming process can be conducted on the eutectic alloy which has a quasicrystalline phase to a maximum of 30% of the alloy volume. In this connection, a hot rolling process is not successfully achieved in an alloy throughout which a quasicrystalline phase is distributed at a volume higher than 30% because the quasicrystalline phase is of high brittleness. Thus, the quantity of the quasicrystalline phase is limited to 30% by volume in the alloy.

The magnesium-based metallic alloy which is superior in warm and hot formability and has such a dispersed quasicrystalline phase as to afford high strength and elongation can be obtained when they have a composition of Mg—1~10 at % Zn—0.1~3 at % Y. The reason that the composition of the alloy is limited to such ranges is as follows.

When the content of Zn is below 1 at %, the resulting quasicrystalline phase is too low in volume to achieve the desired effects. On the other hand, when Zn is used at an amount larger than 3 at %, the quasicrystalline phase is too high in volume, so that the material is increased in brittleness.

Less than 0.1 at % of Y results in too low a volume of the quasicrystalline phase, making it difficult to achieve desired effects. On the other hand, an excess quasicrystalline phase results when using Y at an amount larger than 3 at %, so that the brittleness of the material is increased.

Generally, a plate material can be successfully produced into final products only when it has an elongation of at least 50% at forming temperatures.

At a temperature as high as or higher than one third of the melting point, which is the typical forming temperature for general metallic materials when using a warm or hot forming process, the plate is found to be of high formability as its elongation is measured to be 50% or higher. After undergoing this warm or hot forming process, the quasicrystalline phase is further dispersed and thus more homogeneously distributed throughout the matrix metal while stably maintaining the interface to the matrix metal, thereby bringing about a significant reinforcement effect attributed to the dispersion of the quasicrystalline phase.

A better understanding of the present invention may be obtained in light of the following examples which are set forth to illustrate, but are not to be construed it the present invention.

EXAMPLE

Molten metal of Mg—Zn—Y was prepared according to the compositions listed in Table 1 below, and cast into

TABLE 1

| Alloy | Alloy Composition (at %) | | | Eutectic Phase at | Quasi-crystalline Fraction | Rolling |
|---|---|---|---|---|---|---|
| # | Mg | Zn | Y | Solidification | (vol %) | Possibility |
| 1 | 68 | 28 | 4 | Quasicrystalline | | |
| 2 | 70 | 25.7 | 4.3 | Alpha Mg | | |
| 3 | 71.8 | 25.2 | 3 | Alpha Mg | | |
| 4 | 73.2 | 23 | 3.8 | Alpha Mg | | |
| 5 | 73.8 | 22.5 | 3.7 | Alpha Mg | | |
| 6 | 74.7 | 21.7 | 3.6 | Alpha Mg | | |
| 7 | 80 | 17.1 | 2.9 | Alpha Mg | | |
| 8 | 86 | 12 | 2 | Alpha Mg | 33 | × |
| 9 | 90 | 8.6 | 1.4 | Alpha Mg | 20 | ○ |
| 10 | 95 | 4.3 | 0.7 | Alpha Mg | 15 | ○ |
| 15 | 97.8 | 2 | 0.2 | Alpha Mg | 4 | ○ |

In the case of alloy #1, the primary solid phase is a quasicrystalline phase in a solid structure. On the other hand, during solidification, alloys #2 to 11 showed the primary solid phase as a magnesium-base solid solution (alpha magnesium matrix) while having a quasicrystalline phase as a second phase. Thus, alloy compositions provided to the alloys #2–11 fall within the range suitable in the present invention when their solidification structures are taken into account.

Figure 2:
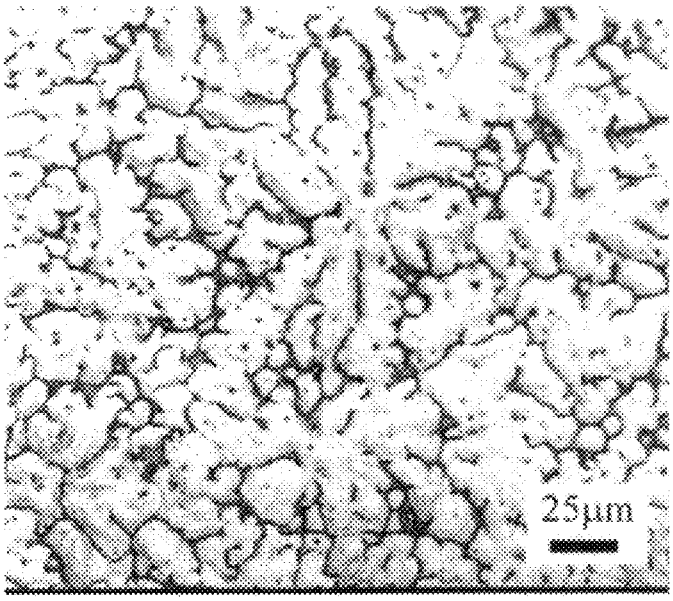
FIG. 2 is an optical photograph taken of a eutectic alloy, showing a solidification structure in which an alpha magnesium matrix is formed as a dentritic structure with interdentritic segregation of a eutectic phase (alpha magnesium and quasicrystalline phase).

With reference to FIG. 2, there is an optical photograph taken of the alloy #10, showing a solidification structure in which an alpha magnesium matrix is formed as a dentritic structure with interdentritic segregation of a eutectic phase (alpha magnesium and quasicrystalline phase). In each alloy composition shown in Table 1, the fraction of the quasicrystalline phase was found to be, by volume, about 33% for the alloy #8, about 20% for the alloy #9, about 15% for the alloy #10, and about 4% for the alloy #11 as measured by an image analyzer.

After being preheated for 20 min in a furnace at half the melting point or higher than the melting temperature at which general metallic materials are formed, e.g., in a furnace of 400° C., the alloys #8 to 11 was hot rolled according to a hot rolling process that is usually used for general wrought metallic materials. That is, the hot rolling was conducted in multiple passes at a temperature of 400° C. using 10% thickness reduction per pass to reduce the original body thickness to a final hot rolled thickness of 1.7 mm; i.e. a total reduction in thickness of 80%.

Figure 3:
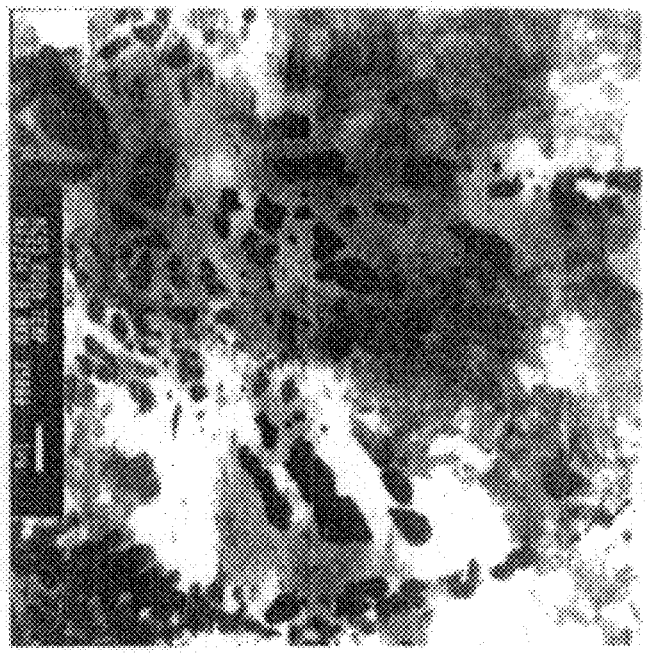
FIG. 3 is a transmission electron microphotograph showing a structure of a hot-rolled plate made of the eutectic alloy of FIG. 2, in which the quasicrystalline phase of the hot-rolled plate forms a stable interface to the matrix, being broken down into microparticles.

Owing to the existence of an excessive amount of quasicrystalline phase, the alloy #8 was not hot rolled successfully. Success was achieved in hot rolling the alloys #9, 10 and 11. The structure of the hot-rolled plate is shown in FIG. 3. The quasicrystalline phase of the hot-rolled plate forms a stable interface to the matrix as shown in the transmission electron micrograph of FIG. 3. In detail, the quasicrystalline phase was identified to be broken down into micro-scale fine particles during the hot rolling and dispersed throughout the matrix through thermal energy-induced mass flow, forming a stable interface to the matrix without destroying the matrix nor separating from the matrix.

Figure 4:
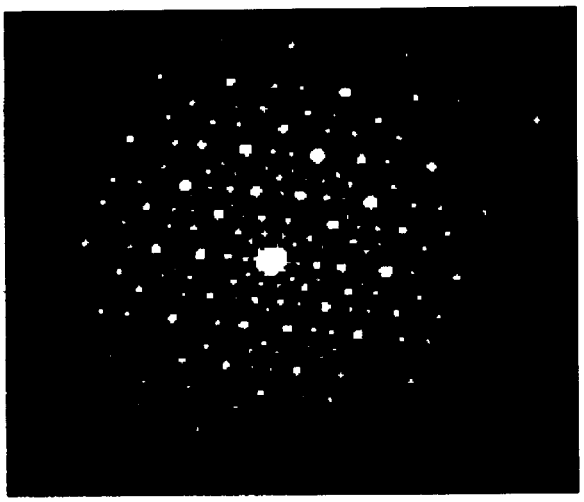
FIG. 4 is an electron microscopic diffraction pattern identifying the crystal structure of the second phase of the alloy.

In addition, in order to determine the crystal structure of the second phase, a diffraction pattern of the second phase existing in the alloy was observed under an electron microscope. The result is given in FIG. 4. As shown in the diffraction pattern, the crystal structure of the second phase present in the alloy of the present invention is found to have a five-fold rotational axis of symmetry, which is typical of a quasicrystal.

Therefore, the Mg-based alloy with superior hot formability and a dispersed quasicrystalline phase can be obtained from a composition of Mg—1~10 at % Zn—0.1~3 at % Y.

After being treated at 400° C. for 30 min to be homogenized, the plates (alloys #10 and 11) were prepared into tensile test specimens which were then tested for yield strength, maximum tensile strength, and elongation. The results are given in Table 2, below.

As a rule, since magnesium alloys are generally of hexagonal close-packed structure, they are unlikely to be formed into plates at room temperature. Thus, hot rolling is used to form magnesium alloys into plates. Representative of conventional wrought magnesium-based alloys are AZ31 and ZM21. Along with these representative conventional magnesium alloys, the alloys of the present invention are described with regard to the tested properties in Table 2, below.

TABLE 2

| | Yield Strength (MPa) | Max. Tensile Strength (MPa) | Elongation (%) |
|---|---|---|---|
| Alloy #10 | 225 | 370 | 20 |
| Alloy #11 | 150 | 330 | 28 |
| AZ31B-H24 | 220 | 290 | 15 |
| ZM2-C | 120 | 240 | 11 |
| ZM21-H24 | 165 | 250 | 6 |

As apparent from the data of Table 2, the alloys of the present invention are superior in yield strength, max. tensile strength, and elongation. On the whole, conventional magnesium alloys, listed in Table 2, which are capable of being hot-rolled, form solid solutions, so that only a small quantity of other elements can be permitted in the matrix, resulting in a decrease in their strength. In contrast, the alloys of the present invention, as seen in Table 1, have a quasicrystalline phase which is added at large amounts as a second phase. In addition, the quasicrystalline phase forms a stable interface with the matrix metal, serving to increase the strength of the alloys.

As a rule, an increase in the volume of the second phase in an alloy enlarges the total area of the interface between the particles and the matrix and thus causes a higher probability of interface problems such as interface debonding, finally reducing the elongation of the alloy. However, high elongation percentages were detected in the alloys of the present invention. These results indicate that the stable interface did not act as a source of destruction while the instability of the matrix metal is a fatal weakness.

Plates made of magnesium alloys are prepared into final products through a hot sheet forming process. In this case, an elongation of 50% or higher at the temperature higher than one third of the melting temperature is required to fabricate the final products. Another requirement of the hot forming process is a low flow stress at the forming temperature in view of reduced energy consumption.

Figure 5:
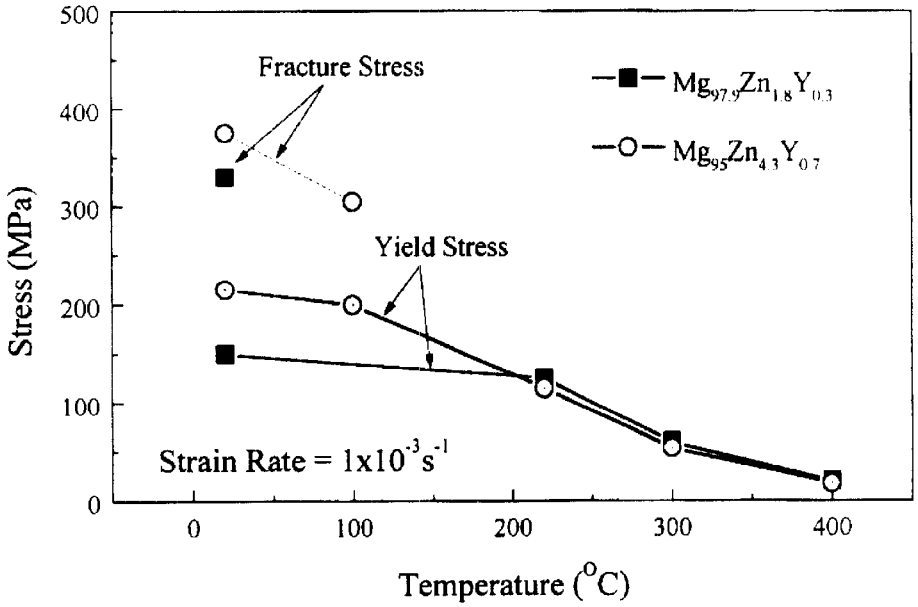
FIG. 5 shows curves in which stresses of the metallic alloys $Mg_{97.9}Zn_{1.8}Y_{0.3}$ (□) and $Mg_{95}Zn_{4.3}Y_{0.7}$ (±) are plotted versus temperature.
Figure 6:
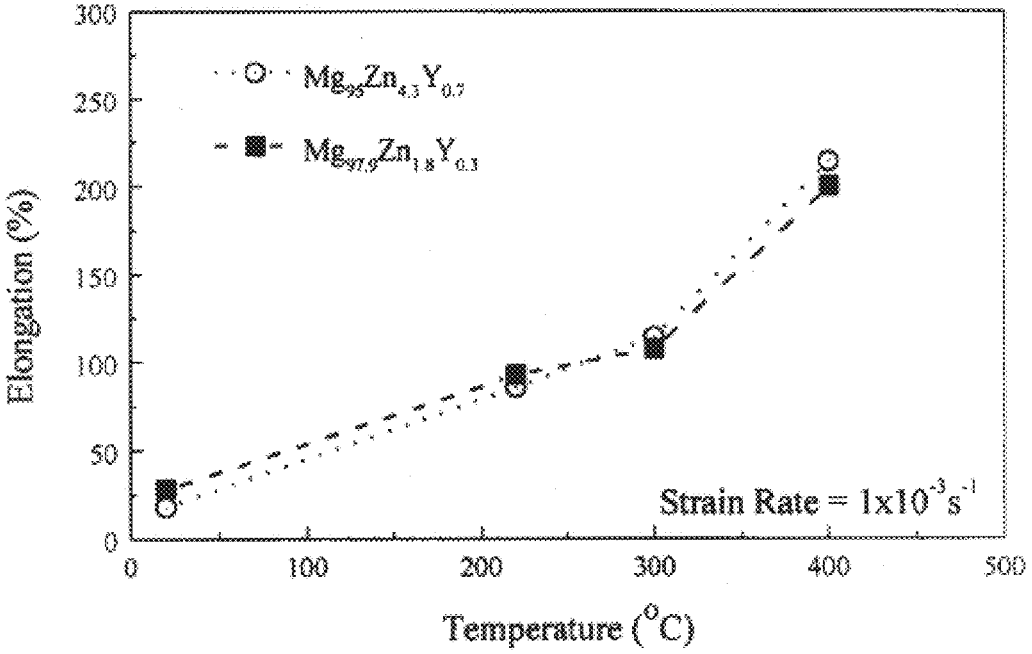
FIG. 6 shows curves in which the elongation of the metallic alloys of the present invention is plotted versus temperature.
Figure 7:
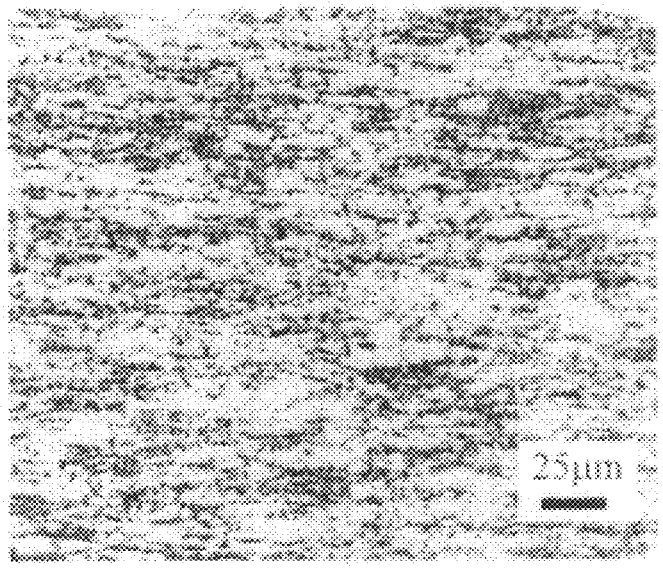
FIG. 7 is an optical photograph showing the structure of a rolled plate made of an alloy of the present invention, in which the quasicrystalline phase is homogeneously distributed, in addition to forming a stable interface with the matrix metal.

With reference to FIG. 5, there are curves in which the fracture stress and yield stress of the metallic alloys $Mg_{97.9}Zn_{1.8}Y_{0.3}$ (□) and $Mg_{95}Zn_{4.3}Y_{0.7}$ (±) are plotted versus temperature. FIG. 6 shows curves in which the elongation of the metallic alloys of the present invention is plotted versus temperature. As seen in these curves, the yield stress does show only a little change up to 100° C., but decreases with increasing of temperature above 100° C. The elongation increases in an almost linear pattern with increasing temperature. Turning now to FIG. 7, there is an optical photograph showing the structure of a rolled plate made of the alloy #10. As seen in FIG. 7, the quasicrystalline phase is homogeneously distributed in addition to maintaining a stable interface with the matrix metal. In this case, a dispersion-induced reinforcement effect comes out more effectively, leading to an increase in strength.

As described hereinbefore, a quasicrystalline phase is formed in a metal solid solution upon solidification and dispersed throughout the matrix through hot forming, thus functioning as a reinforcement in the alloy of the present invention. Therefore, the alloy of the present invention retains not only the excellent mechanical properties that the metallic materials made by conventional various methods show, but also is superior in warm and hot formability. With these advantages, the alloy of the present invention can be prepared into various, final metallic products of high quality on a mass scale. Particularly, the alloy of the present invention is characterized in warm and hot formability because conventional Mg-based alloys are poor in formability. In addition, the alloy of the present invention is used where superior mechanical properties are needed.

Compared to materials formed from conventional Mg-based alloys, the materials obtained through the hot rolling or extrusion of the quasicrystalline phase-reinforced Mg-based metallic alloy of the present invention have an increased volume % of the second phase and thus show significantly increased strength.

Particularly, the materials warm- or hot-rolled or extruded from the alloy of the present invention have much more stable interface between the particles and the matrix and are remarkably improved in elongation upon warm and hot rolling compared to composite metallic materials made by conventional powder metallurgy.

Thanks to excellent warm and hot formability, quasicrystalline microparticles are further homogeneously distributed in the alloy of the present invention during warm and hot forming, thus bringing about a significant improvement in the strength and fracture toughness of final products. Accordingly, the alloy of the present invention is useful as a material for high-quality metallic products which are required to be of light weight, high strength, high toughness and high formability.

Consequently, the alloy of the present invention is suitable for use in casings for portable electronic appliances such as mobile phones, and automobile parts, which require light weight, high strength, high toughness and high formability. Also, the alloy of the present invention can be used where wear-resistance is needed because the quasicrystalline phase has a friction coefficient of as low as 0.1–0.2.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method of making a quasicrystalline phase-reinforced magnesium-based metallic alloy, comprising the steps of:

casting a quasicrystalline phase-reinforced magnesium-based metallic alloy consisting of 1–10 at % Zn, 0.1–3 at % Y, and the remainder Mg into a mass, in which a two-phase region consisting of a quasicrystalline phase and a metal solid solution phase exists; and warm or hot forming the mass to separate and disperse quasicrystalline particles throughout the matrix, so as to provide the quasicrystalline phase-reinforced magnesium-based metallic alloy with improved strength and elongation.

2. The method as set forth in claim 1, further comprising the step of forming the warm- or hot-formed mass into a final product at the temperatures higher than one third of the melting temperature to further homogeneously distribute the quasicrystalline particles.

3. The method as set forth in claim 1, wherein the warm or hot forming step is carried out at a temperature ranging from half the melting point to the melting point and the quasicrystalline phase is present in an amount of 30% by volume or less.

* * * * *